United States Patent [19]

Miller

[11] Patent Number: 4,535,812

[45] Date of Patent: Aug. 20, 1985

[54] TIME CONTROLLED GAS FLOWS

[75] Inventor: Elwood O. Miller, South Plainfield, N.J.

[73] Assignee: The BOC Group, Inc., Montvale, N.J.

[21] Appl. No.: 397,653

[22] Filed: Jul. 12, 1982

[51] Int. Cl.[3] ..... F15B 21/02

[52] U.S. Cl. ..... 137/624.11; 137/624.18; 137/624.2

[58] Field of Search ..... 137/624.11, 624.18, 137/624.2; 251/29

[56] References Cited

U.S. PATENT DOCUMENTS

| | | | |
|---|---|---|---|
| 3,931,832 | 1/1976 | Hodler | 137/624.11 |
| 3,943,972 | 3/1976 | Bitonti | 137/624.11 |
| 3,981,478 | 9/1957 | Borge | 251/29 |

*Primary Examiner*—Gerald A. Michalsky
*Assistant Examiner*—John C. Fox
*Attorney, Agent, or Firm*—David L. Rae; Larry R. Cassett

[57] ABSTRACT

Apparatus for providing a gas flow only for a predetermined time period includes a normally pressurized closed valve in a gas line and a timed valve adapted to remove gas pressure from the normally pressurized closed valve thereby opening the same. The length of time during which such pressure is removed is controlled by the period of time necessary to exhaust pressure in a stage of the timed valve through a variable flow restrictor and upon expiration of such time period, pressure is reapplied to the line valve thereby closing the same. The flow of gas is thus permitted to continue for a predetermined time period following which the gas flow is terminated and relatively simple, conventional valve devices may be utilized to reliably control the gas flow.

4 Claims, 2 Drawing Figures

TIME CONTROLLED GAS FLOWS

BACKGROUND OF THE INVENTION

The present invention relates to apparatus for controlling gas flows and more particularly to apparatus for permitting a gas flow to continue for only a predetermined time period.

There are many instances in which it is necessary to initiate a gas flow for a limited period of time in response to the sensing of a particular condition. For example, in the metal heat treating industry wherein parts are subjected to heat treating operations in a furnace, it is known to supply a flow of purge gas, typically an inert gas, to the furnace upon detection of abnormal conditions therein. For example, in the event the furnace temperature drops below a predetermined level or the oxygen content of the furnace atmosphere exceeds a predetermined value, it is common for safety reasons to simply flood the furnace with a flow of inert or purge gas thereby assuring that safe conditions are retained in the furnace.

Frequently, it is desired to provide for an automatic initiation of a purge gas flow in response to detection of a condition as mentioned above and then to have an operator terminate the flow of purge gas manually when the need for such flow no longer exists. However, in many industrial applications, particular furnaces or other chambers or vessels to which a purge gas flow may be applied are left unattended for significant periods of time. Typically, a furnace may be provided with a certain degree of heat over a weekend or the like to reduce the time necessary to recommence operation. In the event that furnace temperature is lost, or oxygen levels increase to an undesired extent while the furnace is unattended and detection equipment is effective to cause the flow of purge gas to the furnace and to shut the same down, it is economically highly desirable to terminate the flow of the purge gas to avoid wasting the same by unnecessarily introducing the purge gas into the furnace after the same is required for safety purposes.

It is known to those skilled in the art to utilize certain cycle timing devices for controlling gas flows and typically, a mechanical cycle timer may be utilized to supply a gas flow for a predetermined time interval, terminate such flow for a second interval and then reestablish the flow for the first time interval and to repeat the same sequence of steps. These cycle timing systems are relatively complex and rely on numerous moving parts in order to open and close a valve, on an intermittent basis, for predetermined time intervals as, for example, is shown in U.S. Pat. No. 3,211,179. It is, however, known to use pneumatic cycle timing systems as described in U.S. Pat. Nos. 2,760,511 and 3,326,237. These devices are effective to generally control the duty cycle or duration of pulses of a gas flow and typically, such devices utilize gas storage reservoirs in addition to a separate gas supply to provide gas flows at a given rate for a predetermined time interval and to interrupt such flows for another predetermined interval. However, as these cycling devices continually provide intermittent gas flows of particular flow rates, the same are not suitable for use in simply terminating a gas flow after a predetermined time interval has elapsed.

Other attempts to control gas flows, such as purging gases, have involved the use of complex electronic systems such as the apparatus illustrated in U.S. Pat. Nos. 4,064,898 and 4,270,564. In these systems, the duration of a gas flow is controlled by generating electrical pulses at a particular rate and counting the same such that upon reaching a desired count, a valve in a gas flow conduit will be actuated. This apparatus is, however, complex and expensive and does not readily lend itself to widespread use in relatively heavy industrial applications such as in connection with control of flows of a purge gas supplied to heat treating furnaces or the like.

Thus, the prior art exhibits a clear need for relatively simple, inexpensive and reliable apparatus for terminating a gas flow after the same has continued for a predetermined time interval.

OBJECTS

It is an object of the present invention to provide improved apparatus for supplying gas flows.

It is another object of the present invention to provide improved apparatus for automatically terminating a gas flow after a predetermined time period.

It is yet another object of the present invention to provide relatively simple yet reliable apparatus for supplying gas flows for a predetermined time interval.

Other objects of the present invention will become apparent from the following description of exemplary embodiments thereof which follows and the novel features will be particularly pointed out in conjunction with the claims appended hereto.

SUMMARY

In accordance with the invention, a first valve is disposed in a gas line and is maintained in a closed condition by virtue of supplying a gas pressure through a second, timed valve such that upon operation of a third valve in response to a sensed condition, the pressure supplied to the first valve is exhausted through the second valve thereby opening the first valve for a period of time substantially equal to the time required to release pressure on the second valve through a variable flow restrictor. At the end of this time period, the second, timed valve is switched so as to supply the gas pressure to the first valve thereby closing this valve and terminating flow of gas in the conduit.

The particular three-valve gas flow control system according to the invention may utilize conventional fluid control elements and, for example, the first valve may be comprised of a conventional diaphragm valve having a control port. The second, timed valve may be a pneumatic timed valve which is also conventional while the third valve may take the form of a solenoid operated valve. Consequently, the apparatus according to the invention is not comprised of highly sophisticated electronic equipment which tends to be expensive but is comprised of relatively simple, conventional yet reliable fluid control elements as mentioned above.

BRIEF DESCRIPTION OF THE DRAWING

The invention will be more clearly understood by reference to the following description of exemplary embodiments thereof in conjunction with the following drawing in which.

DESCRIPTION OF PREFERRED EMBODIMENT

Figure 1:
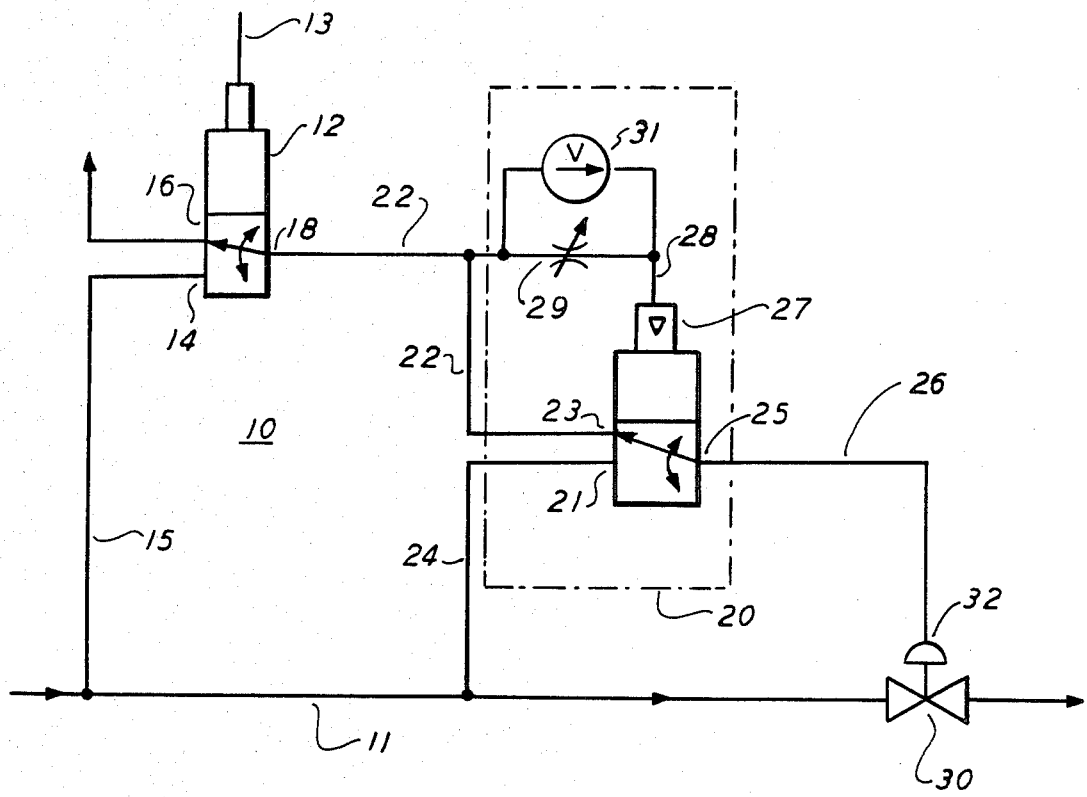
FIG. 1 is a diagrammatic view of the apparatus according to the invention.

Referring now to the drawing, illustrated therein is an exemplary embodiment of the invention which is generally comprised of a configuration of valves 12, 20 and 30 for controlling the flow of a gas, typically a purge or inert gas such as nitrogen, in conduit 11. More particularly, valve 12 is preferably a solenoid valve having an electrical input supplied therethrough to conductor 13. A first port 14 is connected through a conduit 15 to conduit 11 and is effective to supply the gas pressure therein to solenoid valve 12. A second port 16 is connected to a conduit which is effective to exhaust solenoid valve 12 to the ambient atmosphere. Valve 12 is provided with a further port 18 which is connected through line 22 to a second, pneumatic timed valve 20 as will now be described.

Pneumatic timed valve 20 may take the form of a device which when being switched from a first state to a second state will remain in the second state for a predetermined period of time and then switch back to the first state. Valve 20 is commercially available from Kuhnke Company, Atlantic Highlands, N.J. under Model No. 54. More particularly, application of a first gas pressure to the pneumatic timed valve will initially set the valve by coupling one inlet port to the outlet and pressurizing a pilot stage of the valve. Upon detection of a condition as will be described, the pressure in the timed valve is vented for a predetermined time period at the end of which the valve is switched so that the outlet is coupled to a second inlet which in turn is connected to a gas pressure. Referring again to the drawing, pneumatic timed valve 20 is provided with a first port 21 which is connected through conduit 24 to the gas pressure in conduit 11. A second port 23 is connected to conduit 22 and a third port 25 which is selectively coupled to ports 21 and 23 is permanently connected to conduit 26 which in turn is connected to the control port 32 of valve 30 in conduit 11. Initially, the application of pressure through conduit 22 will pressurize pilot chamber 27 by the gas pressure acting through check valve 31 and conduit 28. This is effective to "set" valve 20 by switching port 25 from port 21 to port 23. A variable restrictor 29 is connected in parallel with check valve 31.

The operation of apparatus according to the invention will now be described. Typically, in the normal operation of, for example, a heat treating process or the like, solenoid valve 12 is energized by the supply of a signal to conductor 13. This energization of valve 12 is effective to set the same in a condition such that inlet port 14 is coupled to outlet 18 and such that the gas pressure in conduit 11 is supplied through conduit 15 and valve 12 to conduit 22. Although valve 20 is in an initial or "off the shelf" condition whereby outlet 25 is coupled to inlet port 21, the supply of gas pressure through conduit 22 to pilot stage 27 is effective to set valve 20 so that the gas pressure in conduit 22 is supplied through port 23, outlet 25 and conduit 26 to the control port 32 of valve 30 thereby retaining valve 30 in a closed condition and precluding the flow of gas in conduit 11 through valve 30. As valve 20 is pressurized by the gas pressure in conduit 22, the same pressure is supplied through check valve 31 and conduit 28 to the pilot stage 27 of valve 20. Pilot stage 27 is so pressurized such that upon release of this pressure through flow restrictor 29, pressure will decrease over a predetermined time period as will subsequently be described.

Upon the detection of a given condition by apparatus not shown, i.e. the loss of pressure, abnormal temperature, loss of flow, etc. in a particular process, the electrical signal supplied to conductor 13 will be removed or lost and consequently, solenoid valve 12 will be operated such that outlet 18 is connected to port 16 which in turn is placed in communication with ambient atmosphere. This has the effect of venting the pressure in line 22 which in turn is effective to vent the pressure on control port 32 of valve 30 through conduit 26 and ports 25 and 23 of valve 20 thereby opening valve 30 and permitting the flow of gas in conduit 11 therethrough. At this time, the pressure in pilot stage 27 is permitted to flow or bleed through variable restrictor 29, conduit 22, valve 12 and to ambient and the length of time that will be required for such pressure to dissipate will be determined by the setting of restrictor 29. Consequently, by adjustment of restrictor 29, a predetermined time period required for pressure in pilot stage 27 to dissipate will be established and upon loss of such pressure, valve 20 will be operated such that outlet 25 will be placed in communication with inlet port 21. As a consequence of this operation of valve 20, the gas pressure in conduit 11 will be supplied through conduit 24, valve 20 and conduit 26 to the control port 32 of valve 30 thereby closing this valve at the end of the predetermined time period mentioned above. Thus, the apparatus according to the invention is effective to permit the flow of gas in conduit 11 through valve 30 for only a predetermined time period upon expiration of which such gas flow is terminated.

Finally, upon correction of the condition which led to the loss of the signal previously supplied through conductor 13 to solenoid valve 12, a signal will be reapplied to conductor 13 thereby causing valve 12 to be operated such that outlet 18 is connected to inlet port 14 which in turn will cause operation of valve 20 so that outlet 25 is connected to port 23 and such that pilot stage 27 is repressurized. Consequently, the apparatus according to the invention is reset so that upon the subsequent detection of a particular undesired condition, a flow of gas will be supplied through valve 30 for a predetermined time period.

Figure 2:
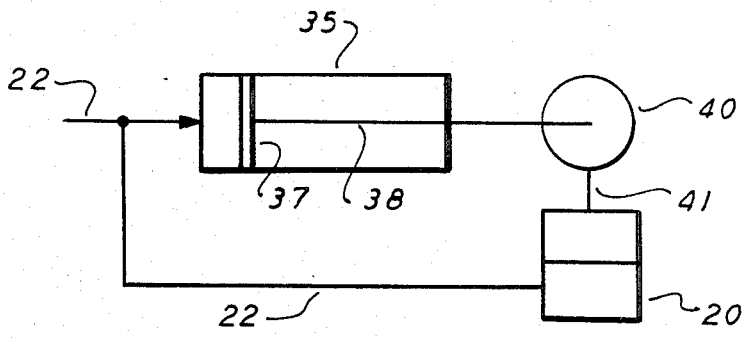
FIG. 2 is a diagrammatic view of a timing mechanism that may be utilized with the apparatus depicted in FIG. 1.

Although specific types of valves 12, 20 and 30 have been described above, it will be appreciated that other flow control elements may also be utilized in accordance with the invention. For example, the apparatus illustrated in FIG. 2 may be utilized as a mechanical timing arrangement in lieu of the use of a flow restrictor 29 and check valve 31 depicted in FIG. 1. In the apparatus illustrated in FIG. 2, a piston arrangement comprised of a piston 37 attached to a rod 38 in cylinder 35 may be utilized to wind a clock mechanism 40 which in turn is mechanically coupled through linkage 41 to valve 20. Upon pressurization of conduit 22, piston 37 and rod 38 are actuated so as to wind clock 40 and upon the release of pressure from valve 20, in a manner similar to that described above, clock 40 will wind down or time out at which point valve 20 will be switched so as to reapply a gas pressure to the control port 32 of valve 30 as illustrated in FIG. 1.

The foregoing and other various changes in form and details may be made without departing from the spirit and scope of the present invention. Consequently, it is intended that the appended claims be interpreted as including all such changes and modifications.

I claim:

1. Apparatus for supplying a flow of gas under pressure through a conduit comprising first valve means disposed in said conduit and having a control port with said first valve means being closed and opened in response to the presence and absence of gas pressure at said control port, respectively;

a pneumatic timed valve adapted to selectively supply said gas pressure to, and for a predetermined time period, remove said pressure from said control port, said pneumatic timed valve having first and second inputs, a pilot stage and timer means for releasing pressure in said pilot stage over said predetermined time period, said second input being connected to said conduit; and a solenoid valve having an output connected to said first input of said pneumatic timed valve, a first port coupled to ambient pressure and a second port connected to said conduit and normally coupled to said output such that the pilot stage of the pneumatic timed valve is connected through said pneumatic timed valve to said control port of said first valve means whereby (i) the gas pressure in said conduit is supplied to said control port to retain the first valve means in a closed condition and (ii) upon activation of said solenoid valve, said pneumatic timed valve is operated to remove said gas pressure from said control port of said first valve means for said predetermined time period.

2. The apparatus defined in claim 1 wherein said first valve means comprises a diaphragm valve.

3. The apparatus defined in claim 1 wherein said timer means are adjustable such that the duration of said predetermined time period may be set at any one of a plurality of values.

4. The apparatus defined in claim 1 wherein upon activation of said third valve means, the first port thereof is connected to its output whereby pressure in the pilot stage of said second valve means is released by passage of gas in the pilot stage through said timer means over said predetermined time period and said output of said second valve means is switched to the first port thereof to remove the pressure supplied to the control port of said first valve means for the duration of said predetermined time period.

* * * * *

UNITED STATES PATENT AND TRADEMARK OFFICE

CERTIFICATE OF CORRECTION

PATENT NO. : 4,535,812

DATED : August 20, 1985

INVENTOR(S) : Elwood O. Miller

It is certified that error appears in the above-identified patent and that said Letters Patent are hereby corrected as shown below:

In claim 1, line 21, before "connected", insert ---normally pressurized and the second port of said solenoid valve is---.

Signed and Sealed this

*Twenty-ninth* Day of *July 1986*

[SEAL]

*Attest:*

DONALD J. QUIGG

*Attesting Officer*

*Commissioner of Patents and Trademarks*